US007502000B2

(12) United States Patent
Yuki et al.

(10) Patent No.: US 7,502,000 B2
(45) Date of Patent: Mar. 10, 2009

(54) DRIVE CIRCUIT AND IMAGE FORMING APPARATUS USING THE SAME

(75) Inventors: Osamu Yuki, Tokyo (JP); Yoshinori Nakajima, Yokohama (JP); Shigeki Kondo, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 723 days.

(21) Appl. No.: 11/045,109

(22) Filed: Jan. 31, 2005

(65) Prior Publication Data

US 2005/0179626 A1 Aug. 18, 2005

(30) Foreign Application Priority Data

Feb. 12, 2004 (JP) ..... 2004-035295

(51) Int. Cl.
*G09G 3/30* (2006.01)

(52) U.S. Cl. ..... 345/77; 345/76; 345/690; 345/691

(58) Field of Classification Search ..... 345/77, 345/76, 690–691
See application file for complete search history.

(56) References Cited

U.S. PATENT DOCUMENTS 6,356,029 B1 * 3/2002 Hunter ..... 315/169.1
6,518,962 B2 2/2003 Kimura et al.
6,661,398 B2 12/2003 Iwasaki
7,142,180 B2 * 11/2006 Akimoto et al. ..... 345/76
7,158,157 B2 * 1/2007 Yamazaki et al. ..... 345/691
2003/0090481 A1 5/2003 Kimura
2005/0024393 A1 2/2005 Kondo et al. ..... 347/2
2005/0179626 A1 8/2005 Yuki et al. ..... 345/76

FOREIGN PATENT DOCUMENTS

JP 59-55487 3/1984

(Continued)

OTHER PUBLICATIONS

Tang, et al. "Electroluminescence of doped organic thin films", J. Appl. Phys. 65(9), pp. 3610-3616 (May 1, 1989).

(Continued)

*Primary Examiner*—Richard Hjerpe
*Assistant Examiner*—Leonid Shapiro
(74) *Attorney, Agent, or Firm*—Fitzpatrick, Cella, Harper & Scinto

(57) ABSTRACT

A drive circuit including a drive transistor for feeding to a load a drive current corresponding to an input signal. The drive circuit has a correction circuit that supplies a correction signal corresponding to an impedance of the load to a gate of the drive transistor to correct the drive current to be fed to the load by the drive transistor, and in which the load is a light-emitting element. One terminal of the light-emitting element is connected to a gate of a transistor for correction, and when a predetermined potential Ps is set to a value calculated by deducting a threshold voltage Vth of the transistor for correction from a terminal potential Pi of the light-emitting element with respect to a drive current, the drive circuit sets a source potential of the transistor for correction to the predetermined potential Ps to thereby generate a voltage corresponding to an impedance of the light-emitting element as a source-to-drain current of the transistor for correction.

7 Claims, 7 Drawing Sheets

FOREIGN PATENT DOCUMENTS

| | | |
|---|---|---|
| JP | H6-995 | 1/1994 |
| JP | 2001-343936 | 12/2001 |
| JP | 2002-373792 | 12/2002 |
| JP | 2003-511724 | 3/2003 |
| JP | 2003-216110 | 7/2003 |
| WO | WO 98/40871 | 9/1998 |

OTHER PUBLICATIONS

Tang, et al. "Organic electroluminescent diodes", Appl. Phys. Lett. 51(12), pp. 913-915 (Sep. 21, 1987).

* cited by examiner

DRIVE CIRCUIT AND IMAGE FORMING APPARATUS USING THE SAME

This application claims priority from Japanese Patent Application No. 2004-035295, filed on Feb. 12, 2004, which is hereby incorporated by reference herein.

BACKGROUND OF THE INVENTION

1. Field of the Invention

The present invention relates to a drive circuit for a load, which can be used in image forming apparatuses, represented by a television receiver, a digital camera, a digital video camera recorder, a monitor of a computer, a printer of an electrophotographic system, and the like. More specifically, the invention relates to a drive circuit for a light-emitting element that can be used in a display and an exposing device that uses a light-emitting element as a load.

2. Related Background Art

As an example of a load, a light-emitting element, in particular, an organic EL (electroluminescent) element is a planar self-luminous element of stacked thin film layers, which is capable of emitting light at a high luminance. This EL element makes it possible to emit light at a low voltage and high efficiency by increasing the number of functional stacked layers of organic layers (see "Applied Physics Letters" Vol 51, 1987, page 913, and "Journal of Applied Physics" Vol. 65, 1989, page 3610). Since the organic EL element can obtain a substantially linear light-emitting intensity with respect to an electrical current, a constant current drive method has been proposed.

FIG. 8 shows an example of a circuit structure of one pixel of a display element using the conventional EL element. In the figure, reference numerals 1, 3 and 4 denote thin film transistors (TFT); reference numeral 2, a capacitor; reference numeral 5, an EL element, reference numeral 6, an ammeter; and reference numeral 7, a power supply. An operation of the circuit will be explained with reference to a timing chart of FIG. 9.

In a predetermined writing period, a source potential Vsig of the n-type TFT 1 is set to a display signal corresponding to a luminance of a display of the pixel in the next frame, a gate potential Vg1 of the TFT 1 rises to H (high level) at time t1 at which the signal is decided, as shown in FIG. 9, and the TFT 1 is turned ON, whereby a charge corresponding to the display signal is accumulated in the capacitor 2. Subsequently, Vg1 falls to L (low level) at t2 and the TFT 1 turns OFF again and, at the same time, a gate voltage Vg2 of the n-type TFT 4 rises to H and the TFT 4 is turned ON. Thus, an electrical current (display current) corresponding to the charge accumulated in the capacitor 2 flows to the TFT 3 to be supplied to the EL element 5, whereby the EL element 5 emits light at a luminance corresponding to the display signal until the next writing is performed. Reference numeral 6 denotes an ammeter, which is unnecessary for an actual drive circuit, but is illustrated here for the explanation of operation.

However, it is known that, even if the organic EL element emits light at a constant current, an impedance changes due to deterioration of stacked organic layers and a luminance falls with time, as shown in FIG. 10. FIG. 10 shows a rough tendency, and actual aged deterioration of characteristics of the organic EL element is not limited to that shown in the figure.

Thus, a method of measuring a drive time to change a luminance and a method of detecting a luminance with a sensor to adjust a drive voltage have been proposed (see Japanese Patent Application Laid-Open No. S59-055487).

Japanese Patent Application Laid-Open No. S59-055487, "Applied Physics Letters" Vol. 51, 1987, page 913, and "Journal of Applied Physics" Vol. 65, 1989, page 3610, propose methods for coping with the fall in luminance due to deterioration of the organic EL element. However, according to these proposals, the methods require means for storing a drive time and a sensor, and it is difficult to compensate for a change in a luminance by a unit of a frame for each pixel.

SUMMARY OF THE INVENTION

It is an object of the invention to provide a drive circuit that can drive a load stably for a long period of time, even if the load deteriorates with time to cause changes in an impedance and a resistance, and an image forming apparatus using the drive circuit.

It is another object of the invention, even in the case in which a load is a light-emitting element having a characteristic of deteriorating with time, to realize stable image formation for a long period of time by detecting a fall in luminance due to aged deterioration of the light-emitting element for each pixel, and correcting (compensating for) the fall in luminance.

A first drive circuit of the invention includes a drive transistor for feeding a drive current corresponding to an input signal to a load, and the drive circuit has a correction circuit that supplies a correction signal corresponding to an impedance of the load to a gate of the drive transistor to correct the drive current to be fed to the load by the drive transistor.

Preferably, the load is a light-emitting element, and the drive circuit feeds an electrical current to the light-emitting element, detects a voltage between both terminals of the light-emitting element to detect an impedance of the light-emitting element, and performs the correction on the basis of a result of the detection.

In addition, preferably, the load is a light-emitting element, one terminal of the light-emitting element is connected to a gate of a transistor for correction, and when a predetermined potential Ps is set to a value calculated by deducting a threshold voltage Vth of the transistor for correction from a terminal potential Pi of the light-emitting element with respect to a drive current, the drive circuit sets a source potential of the transistor for correction to the predetermined potential Ps, thereby, to generate a voltage corresponding to an impedance of the light-emitting element as a source-to-drain current of the transistor for correction.

Preferably, the drive circuit inputs the source-to-drain current of the transistor for correction to the gate of the drive transistor as the correction signal.

Preferably, the drive circuit sets the source potential of the transistor for correction using a nonlinear element having a variable bias voltage or diode characteristic.

Preferably, it is possible to multiply the correction signal with a coefficient according to a setting for a size of the transistor for correction.

An image forming apparatus of the invention includes a pixel circuit group in which plural pixel circuits, which include a light-emitting element and a drive transistor for feeding a drive current corresponding to an input signal to the light-emitting element, are arranged, and each of the pixel circuits has a correction circuit that supplies a correction signal corresponding to an impedance of a load to a gate of the drive transistor and corrects the drive current to be fed to the light-emitting element by the drive transistor.

Preferably, the light-emitting element is an organic electroluminescent element.

In addition, preferably, the pixel circuit group is arranged in a two-dimensional matrix shape, and the image forming apparatus includes a display unit that forms an image in the pixel circuit group according to light emission of the light-emitting element, a line drive circuit that supplies an image signal to the pixel circuit group, an image data supply circuit that supplies image data to the line drive circuit, and a decoder that decodes compressed image data stored in a storage medium and supplies the decoded image data to the image data supply circuit.

Preferably, the image forming apparatus includes a photosensitive member, an exposure device that has the pixel circuit group arranged at least in a one-dimensional matrix shape and is used for forming a latent image on the photosensitive member according to light emission of the light-emitting element, a developing device, a line drive circuit that supplies an image signal to the pixel circuit group, and an image data supply circuit that supplies image data to the line drive circuit.

Another drive circuit of the invention includes a drive transistor for feeding a drive current corresponding to an input signal to a load, and the drive circuit has a correction circuit that supplies a correction signal corresponding to an amount of deterioration of the load to a gate of the drive transistor to correct the drive current to be fed to the load by the drive transistor.

Still another drive circuit of the invention includes a drive transistor for feeding a drive current corresponding to an input signal to a load, a storage capacitor that is connected to a control electrode of the drive transistor and is used for retaining an input signal, a detection circuit for detecting a resistance of the load, and a correction circuit that feeds back a result of the detection by the detection circuit to the drive transistor to correct a drive current to be fed to the load by the drive transistor.

Preferably, the detection circuit includes a second capacitor that is connected to a terminal, which is connected to the load, via a switching transistor, and the correction circuit includes a transistor for correction, which has a control electrode connected to the second capacitor and is used for changing a potential of the control electrode of the drive transistor.

An image forming apparatus of the invention is an image forming apparatus that includes a pixel circuit group in which plural pixel circuits, which include a light-emitting element serving as a load and the drive circuit, described above, are arranged. In the image forming apparatus, preferably, the pixel circuit group is arranged in a two-dimensional matrix shape, and the image forming apparatus includes a display unit that forms an image in the pixel circuit group according to light emission of the light-emitting element, a line drive circuit that supplies an image signal to the pixel circuit group, an image data supply circuit that supplies image data to the line drive circuit, and a decoder that decodes compressed image data stored in a storage medium and supplies the decoded image data to the image data supply circuit.

An image forming apparatus of the invention is an image forming apparatus that includes a pixel circuit group in which plural pixel circuits, which include a light-emitting element serving as a load and the drive circuit described above, are arranged. Preferably, the image forming apparatus includes a photosensitive member, a charging device for charging a photosensitive member, an exposing device that has the pixel circuit group arranged at least in a one-dimensional matrix shape and is used for forming a latent image on a photosensitive member according to light emission of the light-emitting element, a developing device, a line drive circuit that supplies an image signal to the pixel circuit group, and an image data supply circuit that supplies image data to the line drive circuit.

According to the invention, even if a load deteriorates with time to cause changes in an impedance and a resistance, feedback provides stable drive over a long period of time.

For example, in the case in which a light-emitting element having a characteristic of deteriorating with time to have a low luminance is used as a load, it is possible to perform correction of a luminance by a unit of a frame for each pixel. Thus, the aged deterioration of the light-emitting element does not affect an image, and it is possible to display a stable image for a long period of time. Consequently, the present invention is used in an image forming apparatus, such as a display, and an image forming apparatus of the electrophotographic system, suitably.

DESCRIPTION OF THE PREFERRED EMBODIMENTS

First, in order to facilitate understanding of an operation of a drive circuit of the invention, a basic operation will be explained with reference to the accompanying drawings.

Figure 8:
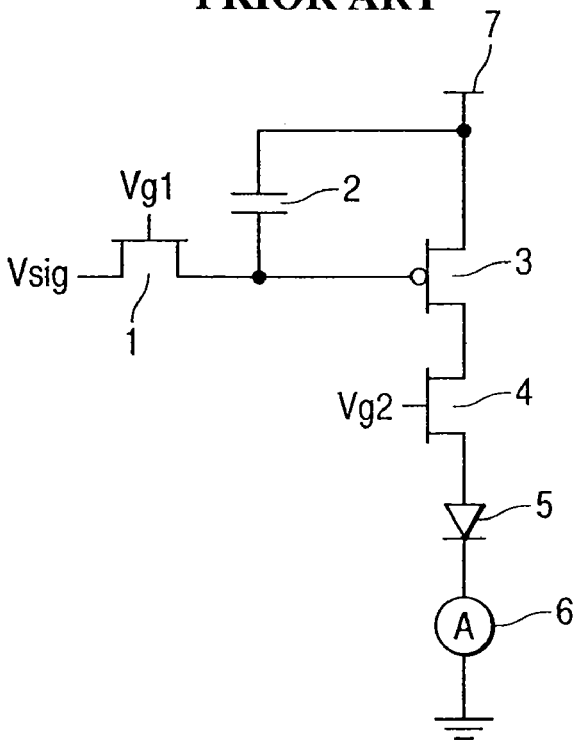
FIG. 8 PRIOR ART
FIG. 8 is a pixel circuit diagram of a conventional display element.
Figure 9:
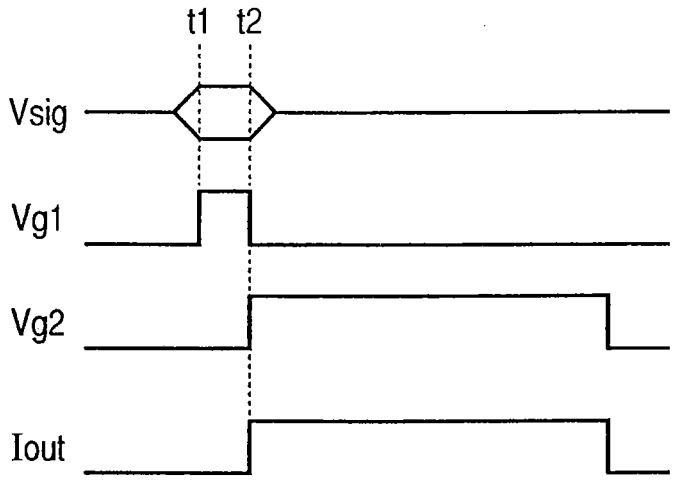
FIG. 9 PRIOR ART
FIG. 9 is a timing chart of an operation of a circuit in FIG. 8.
Figure 10:
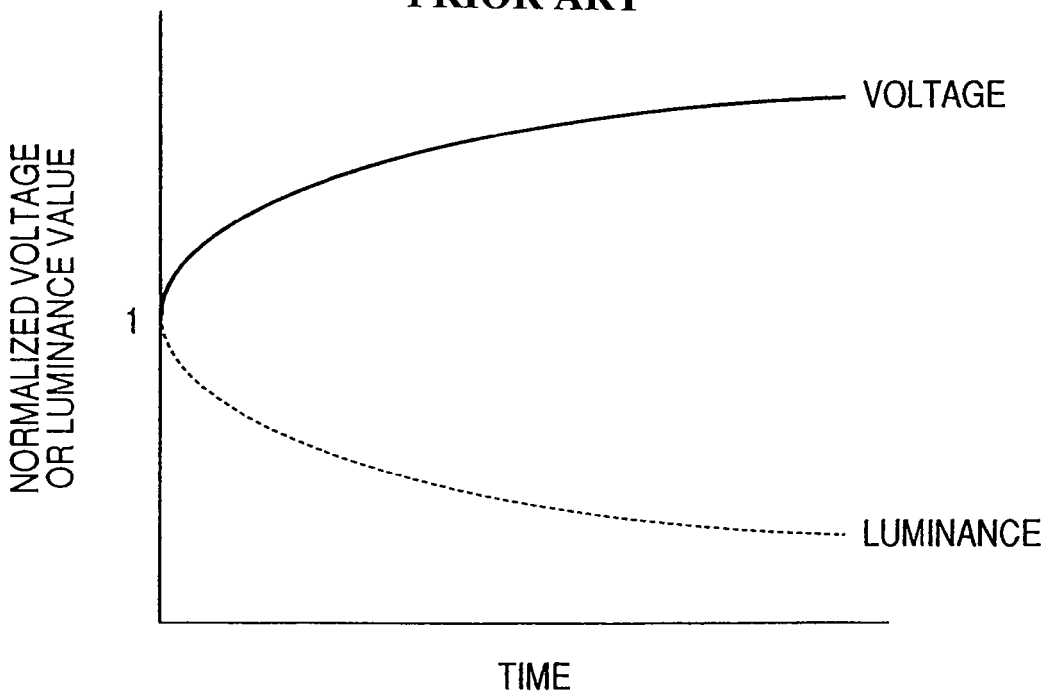
FIG. 10 PRIOR ART
FIG. 10 is a diagram showing aged deterioration of a light-emitting element of the circuit in FIG. 8.

In a circuit shown in FIG. 8, a luminance of a light-emitting element 5 serving as a load, to which a predetermined electrical current is supplied, falls with time, as shown in FIG. 10, and a voltage between both terminals of the light-emitting element 5 rises. This is because an impedance of the light-emitting element 5 rises due to deterioration of organic layers of the light-emitting element 5. In an embodiment of the present invention, the voltage rise at this point is detected as an amount of impedance change in the light-emitting element 5 and the amount of impedance change is fed back to a TFT 3, serving as a drive transistor, to adjust an amount of electrical current to be supplied to the light-emitting element 5 by the TFT 3, whereby an electrical current flowing to the light-emitting element 5 is corrected, to correct a luminance of the light-emitting element 5.

Figure 11:
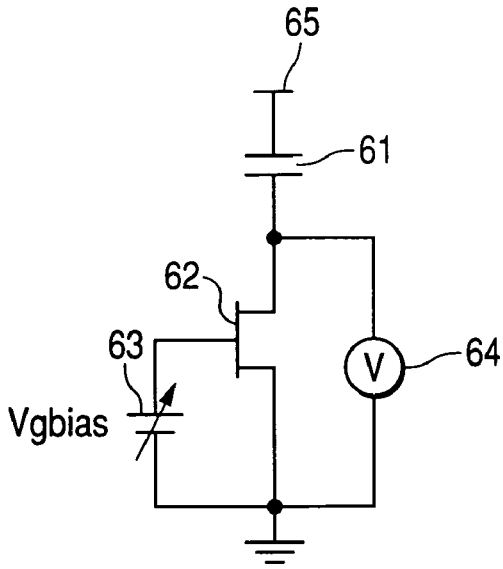
FIG. 11 is a diagram showing a current correction circuit manufactured on trial.

As shown in FIG. 10, a voltage change draws a curved line. On the other hand, a luminance change draws a curved line of a curve substantially opposite to a curve of a voltage rise. A circuit shown in FIG. 11 is manufactured on trial. In the figure, reference numeral 61 denotes a capacitor; reference numeral 62, a TFT; reference numeral 63, a variable bias voltage; and reference numeral 64, a voltmeter. The TFT 62 is an n-channel type TFT. As a potential of a control terminal of the TFT 62 provided on a common side of the capacitor 61, a variable bias voltage Vgbias is changed by the variable bias voltage 63 in a range from a threshold value of the TFT 61 to a working current value. As a result, a source-to-drain voltage of the TFT 62 shows a characteristic shown in FIG. 12. The characteristic is opposite to a source-to-drain current characteristic of a p-type TFT 3 shown in FIG. 8. A voltage of the capacitor 61 is proportional to an amount of charge. In other words, the voltage is proportional to a conducting time of the source-to-drain current of the TFT 62. Therefore, if the circuit shown in FIG. 11 is incorporated in the circuit shown in FIG. 8, to use the source-to-drain voltage of the TFT 62 as a gate voltage of the TFT 11 of the circuit shown in FIG. 8, the fall of luminance of the light-emitting element 13 could be compensated for linearly, by applying a voltage, which changes substantially linearly, to the control terminal of the TFT 62.

Here, as the load that can be used in the present invention, there are an LED formed of an inorganic material, an LED formed of organic material (this is often called an organic EL), an electron-emitting element, a light-emitting element formed of an electron-emitting element and a phosphor, and the like. In particular, a light-emitting element, which can adjust a luminance according to a current value, is appropriate.

As a transistor used in the invention, an insulated gate transistor, more specifically, an MOS transistor using bulk silicon may be used. However, a thin film transistor (TFT) having a semiconductor layer on an insulating surface of a substrate is preferably used. As the TFT, any of a TFT using a so-called amorphous semiconductor, a TFT using a polycrystal semiconductor, and a TFT using a monocrystal semiconductor, may be used. However, the TFT using a polycrystal semiconductor, in particular, a low-temperature polysilicon TFT, is used appropriately.

A specific example of a circuit structure will be explained.

First Embodiment

Figure 1:
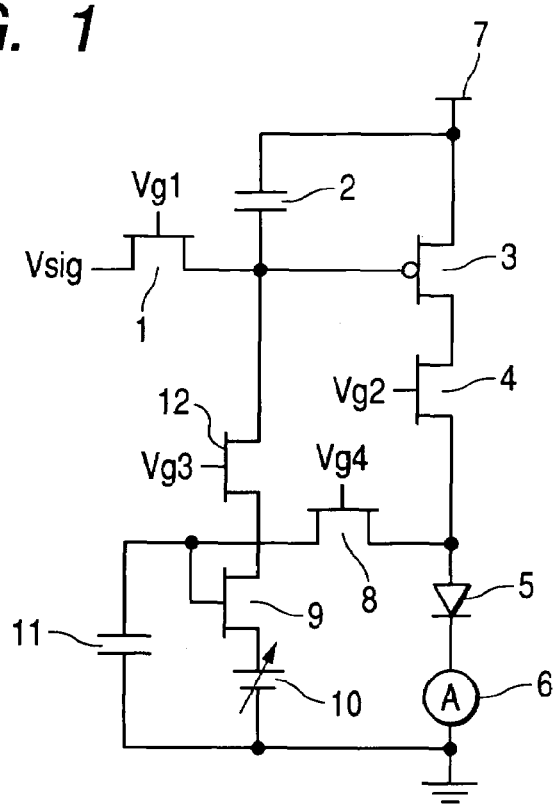
FIG. 1 is a pixel circuit diagram of an embodiment of the invention.

FIG. 1 shows a pixel circuit of an embodiment of a display element of the invention. As a load, a light-emitting element 5 is used. In the figure, reference numerals 1, 3, 4, 8, 9 and 12 denote TFTs. Only the TFT 3 is a p type and the other TFTs are an n type. Reference numerals 2 and 11 denote capacitors; reference numeral 6, an ammeter; reference numeral 7, a power supply; and reference numeral 10, a variable or fixed bias voltage supply. In the figure, the TFT 3 is a drive transistor and the TFT 9 is a second transistor. The ammeter 6 is unnecessary in an actual drive circuit.

Figure 2:
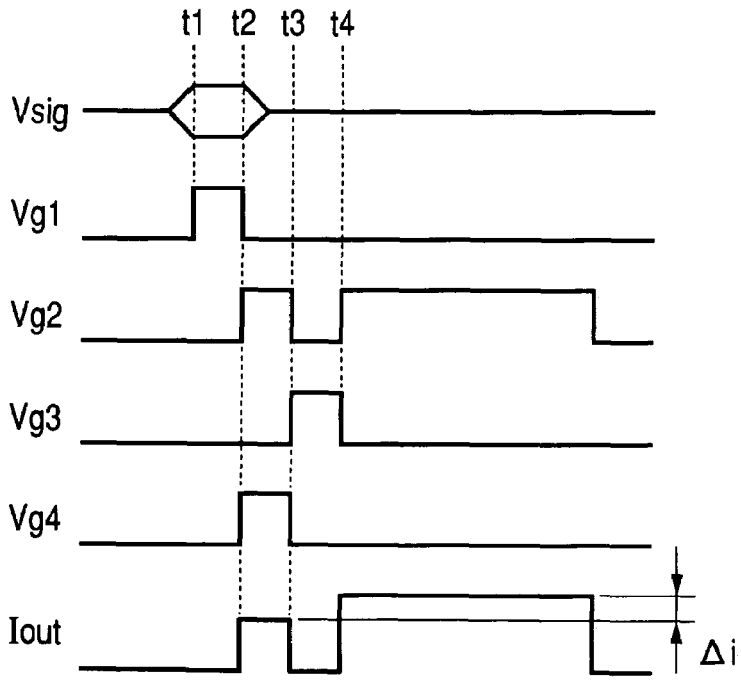
FIG. 2 is a timing chart of an operation of a circuit in FIG. 1.

A drive circuit for the load of this embodiment is a voltage programming type. An input signal according to a voltage corresponding to a display luminance is applied to each pixel circuit as a display signal Vsig. An operation of the pixel will be explained according to a timing chart of FIG. 2.

The display signal Vsig corresponding to a luminance of a display in the next frame is inputted to an input terminal of an n-channel TFT, serving as a transistor for address. At a decided time t1, a gate voltage Vg1 of the TFT 1 serving as the transistor for address rises to H, the TFT 1 is turned ON, a charge corresponding to a voltage value of the display signal is accumulated in a storage capacitor 2, and a gate of the p-channel TFT 3, serving as the transistor for drive, has a potential corresponding to the display signal.

At time t2, Vg1 falls to L, the TFT 1 is turned OFF and, at the same time, Vg2 rises to H and the TFT 4 serving as a switching transistor is turned ON. Consequently, the TFT 3 supplies a current (display current Iout) of a value corresponding to a gate potential to the light-emitting element 5 via the TFT 4. In addition, at the time t2, Vg4 also rises to H and the TFT 8, serving as a second switching transistor, is turned ON, and a gate potential of the TFT 9, serving as a transistor for correction, is equal to an input terminal (anode) potential of the light-emitting element 5. Here, if a source of the TFT 9 is set to a value found by deducting (a threshold value of the TFT 9 from an anode potential of the light-emitting element 5 with respect to a display current), that is, when a predetermined potential is defined as Ps, an anode terminal potential of a light-emitting element with respect to a drive current is defined as Pi, and a threshold voltage of the transistor for correction 9 is defined as Vth, a relation among Ps, Pi and Vth is set as Ps=Pi+Vth, a source potential of the transistor for correction is set to the predetermined potential Ps. Consequently, an amount of a voltage increased by deterioration can be extracted as a source-to-drain current (correction signal) of the TFT 9.

In this way, after the source-to-drain current of the TFT 9 is decided, Vg4 is decreased to L to turn off the TFT 8 at time t3 and, at the same time, Vg3 is increased to H to turn ON the TFT 12, serving as a switching transistor, whereby the source-to-drain current of the TFT 9 is fed from the capacitor 2. As a result, a gate potential of the TFT 3 falls, an amount of an electrical current supplied to the light-emitting element 5 by the TFT 3 increases (Δi), and the light-emitting element 5 emits light at the same luminance as before the deterioration. Since a relation between the electrical current and the luminance is linear, the luminance is corrected according to the relation shown in FIG. 10.

More specifically, in the case of the pixel circuit in which a power supply voltage of the power supply 7 is set to be about 10V, a voltage to be inputted and held in the storage capacitor 2 is set to be about 7.3V, an output voltage of the variable bias voltage source 10 is set to be about 2.5V, and a voltage of about 5V is detected in the capacitor 11, as the pixel circuit continues to be used for a long period of time, a luminance of an organic EL element, serving as a light-emitting element, falls and a resistance increases, and an anode voltage of the light-emitting element increases accordingly. When the TFT 8 is turned ON to detect the increase of the anode voltage, since a voltage of about 6V is detected in the capacitor 11, the TFT 9, serving as a transistor for correction, attempts to feed a current more, because a gate voltage of the TFT 9 increases. Thus, when the TFT 12 is turned ON, since the voltage held by the storage capacitor 2 falls to a value lower than 7.3V and the gate voltage of the TFT 3, serving as the transistor for drive, falls, the TFT 3 attempts to feed a larger current. In this way, a drive current larger than that before the use in the long period of time flows to the organic EL element. Thus, even after the use in the long period, the organic EL element can emit light at the same luminance as before the use.

Figure 12:
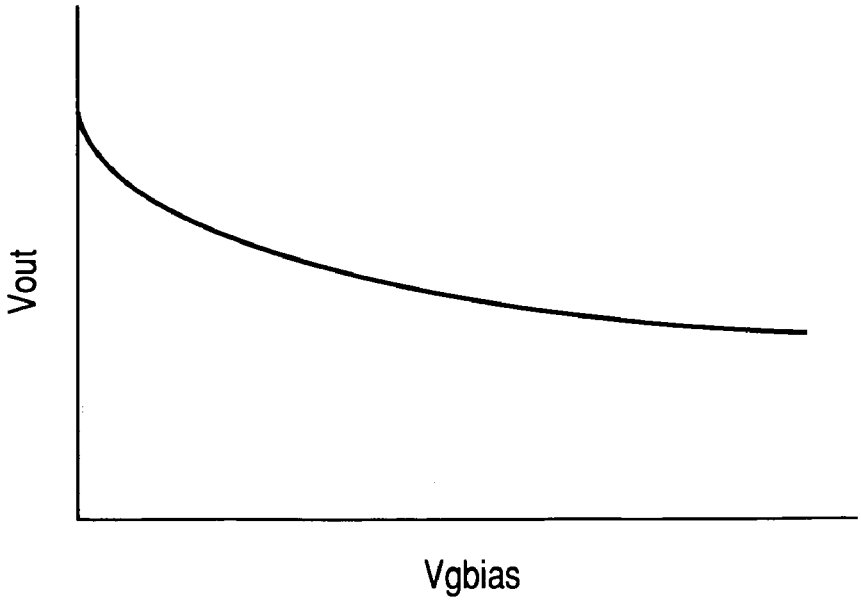
FIG. 12 is a diagram showing a characteristic of the circuit shown in FIG. 11.

In this embodiment, a size of the TFT 9 is adjusted to change a gate voltage-drain current characteristic of the TFT, whereby it is possible to multiply the correction signal with a coefficient to change a relation between Vgbias and Vout of a TFT 62 (equivalent to the TFT 9) shown in FIGS. 11 and 12, and to keep a luminance according to the voltage-luminance characteristic, shown in FIG. 10, constant.

Second Embodiment

Figure 3:
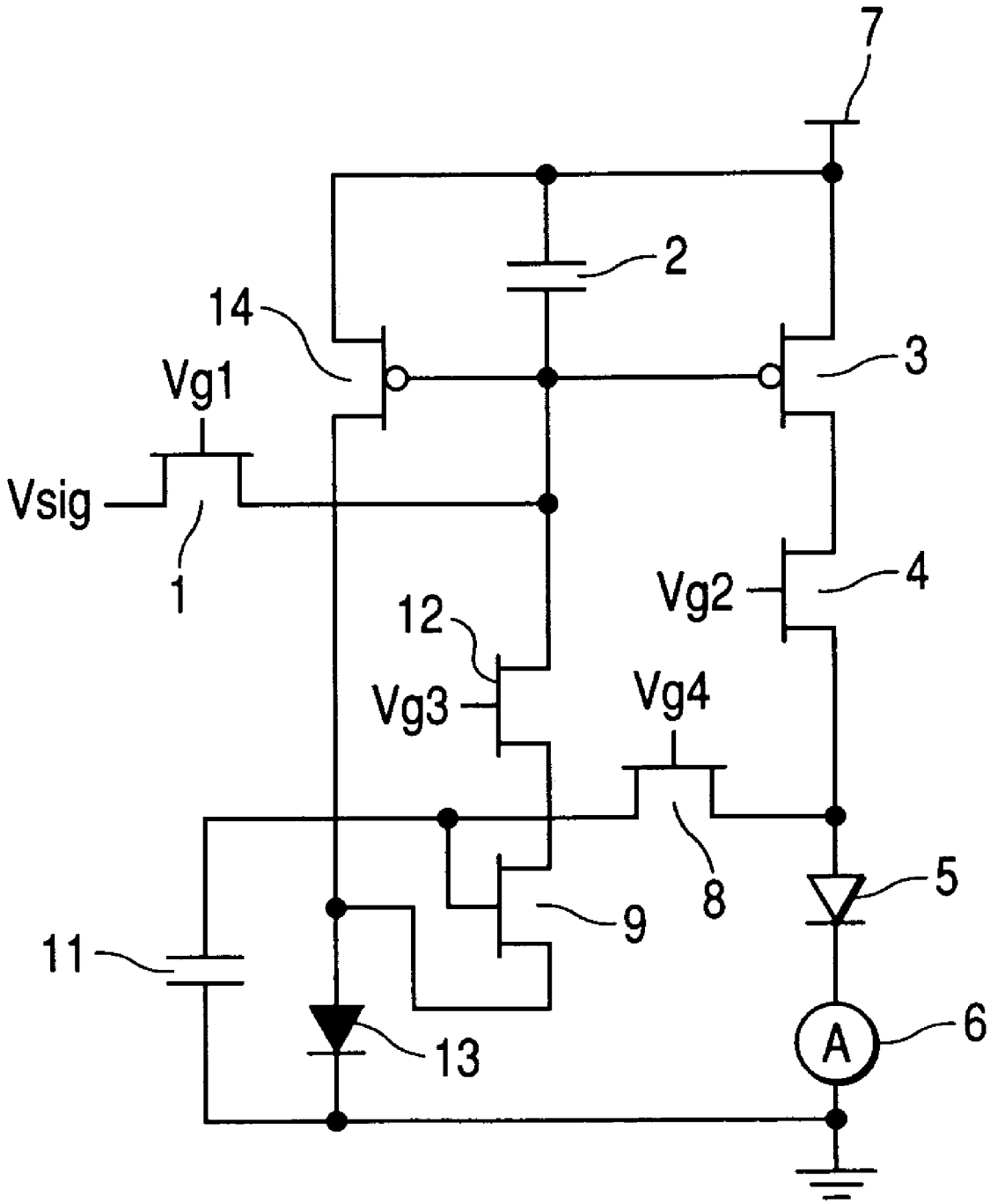
FIG. 3 is a pixel circuit diagram of another embodiment of the invention.

FIG. 3 shows a pixel circuit of a second embodiment of the display element of the invention. In the figure, reference numeral 12 denotes a nonlinear element having a diode characteristic and 14 denotes a p-type TFT. As a load, the light-emitting element 5 is used.

In the pixel circuit of this embodiment, the variable bias voltage 10 of the pixel circuit of the first embodiment is changed to a nonlinear element 13 and a current mirror circuit is constituted by the TFT 3 and TFT 14 serving as the drive transistors. An operation of this pixel circuit will be explained according to a timing chart of FIG. 2.

When a display signal is decided at time t1, Vg1 rises to H and the TFT 1 is turned ON, a charge corresponding to a display signal is accumulated in the capacitor 2, and gate potentials of the TFTs 3 and 14 are set. Subsequently, at the time t2, Vg1 falls to L and, at the same time, Vg2 and Vg4 rise to H, and the TFT 1 is turned OFF and the TFTs 4 and 8 are simultaneously turned ON. As a result, an electrical current corresponding to the display signal is supplied to the light-emitting element 5 and the gate of the TFT 9 from the TFT 3 via the TFT 4. Here, an electrical current of the same value as that of the display current supplied to the light-emitting element 5 is also fed to the nonlinear element 13 by a current mirror circuit constituted by the p-type TFTs 3 and 14. Consequently, a bias voltage of the source of the TFT 9 is set to a forward potential (set in advance to a value obtained by subtracting a threshold value of the TFT 9 from an anode potential of the light-emitting element 5 with respect to the display current). In other words, when a predetermined potential is defined as Ps, an anode terminal potential of a light-emitting element with respect to a drive current is defined as Pi, and a threshold voltage of the transistor for correction 9 is defined as Vth, a relation among Ps, Pi and Vth is set as Ps=Pi+Vth, and the diode 13, serving as the nonlinear element, is designed such that a source potential of the transistor for correction is a predetermined potential Ps. As a result, an amount of a voltage increased by the deterioration can be extracted as a source-to-drain current (correction signal) of the TFT 9.

After the source-to-drain current of the TFT 9 is decided, at time t3, Vg4 is decreased to L to turn OFF the TFT 8 and, at the same time, Vg3 is increased to H to turn ON the TFT 12, whereby the source-to-drain current of the TFT 9 is supplied to the capacitor 2. As a result, a gate potential of the TFT 3 falls, an amount of an electrical current supplied to the light-emitting element 5 by the TFT 3 increases, and the light-emitting element 5 emits light at the same luminance as that before the deterioration. Since a relation between the electrical current and the luminance is linear, the luminance is corrected according to the relation shown in FIG. 10.

In this embodiment, it is also possible to multiply the correction signal with a coefficient by adjusting a size of the TFT 9.

Third Embodiment

Figure 4:
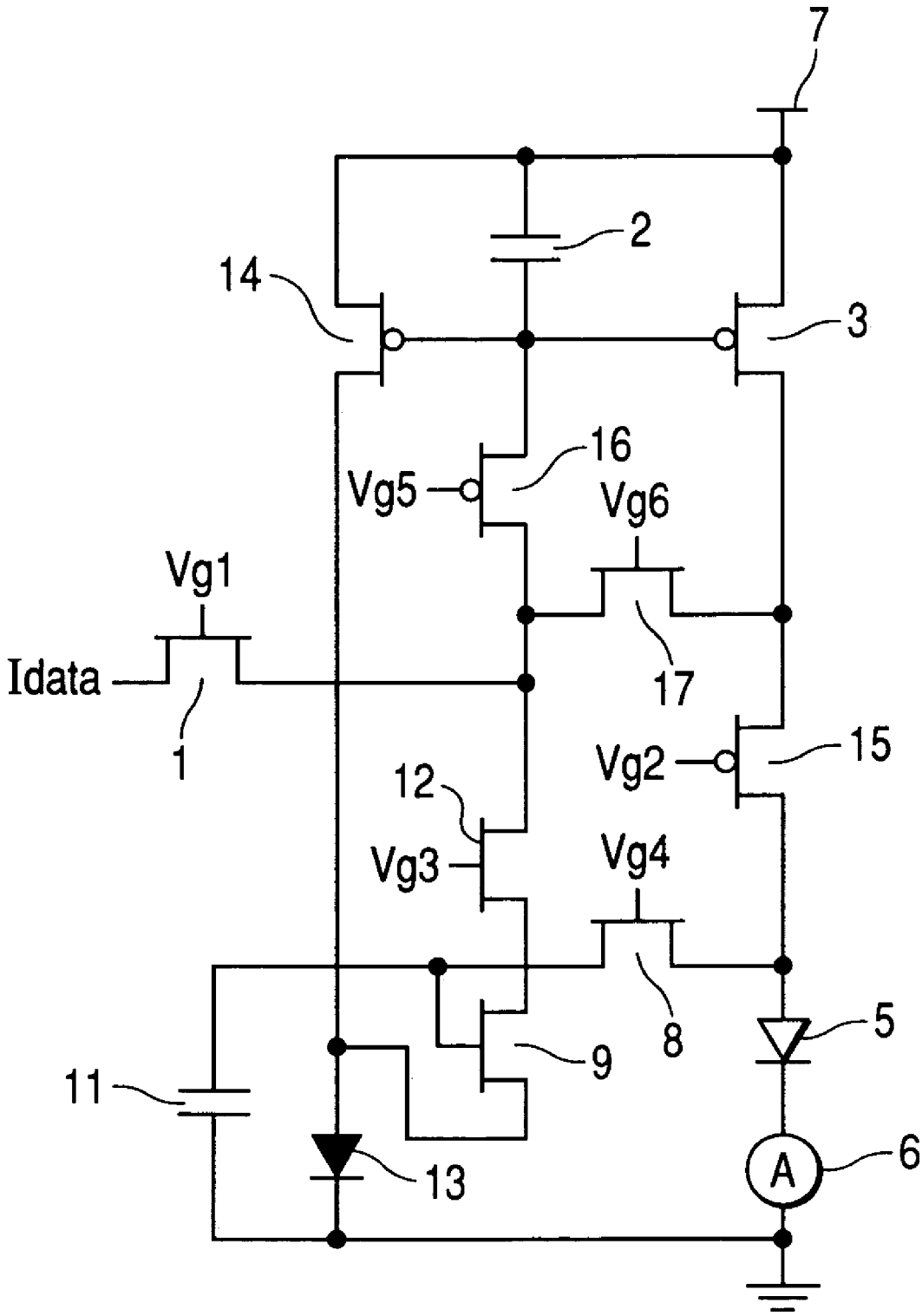
FIG. 4 is a pixel circuit diagram of another embodiment of the invention.

FIG. 4 shows a pixel circuit of a third embodiment of the display element of the invention. In the figure, reference numerals 3, 14, 15 and 16 denote p-type TFTs and reference numerals 1, 8, 9, 12 and 17 denote n-type TFTs. As a load, the light-emitting element 5 is used.

Figure 5:
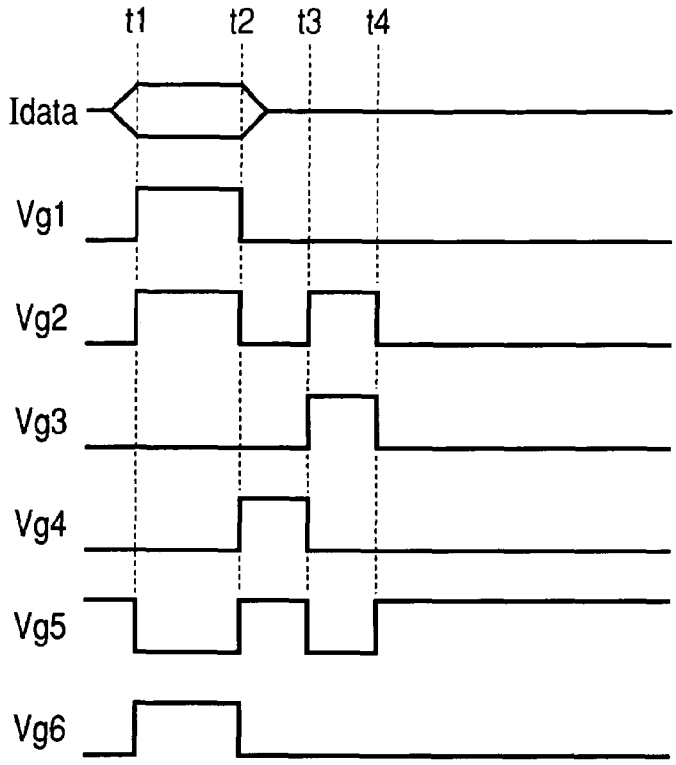
FIG. 5 is a timing chart of an operation of a circuit in FIG. 4.

The display element is a current programming type, and a display signal Idata, according to a current corresponding to a display luminance, is applied to each pixel circuit as an input signal. An operation of the pixel will be explained with reference to a timing chart shown in FIG. 5.

A display signal corresponding to a luminance of display in the next frame is inputted to an input terminal of the n-channel TFT 1, serving as a transistor for address, and, at decided time t1, gate potentials Vg1 and Vg6 of the TFTs 1 and 17 rise to H. At the same time, a gate potential Vg5 of the TFT 16 falls to L, the TFTs 1, 17 and 16 are turned ON and a charge corresponding to a voltage value of the display signal is accumulated in the capacitor 2, and gates of the TFTs 3 and 14 have potentials corresponding to the display signal.

At time t2, Vg1 and Vg6 fall to L and Vg5 rises to H, and the TFTs 1, 17 and 16 are turned OFF. At the same time, Vg2 falls to L and Vg4 rises to H, the TFTs 8 and 15 are turned ON, and an electrical current corresponding to the display signal is supplied to the light-emitting element 5 and a gate of the TFT 9 from the TFT 3 via the TFT 15. Here, an electrical current of the same value as that of the display current supplied to the light-emitting element 5 also flows to the nonlinear element 13. Consequently, a bias voltage of the source of the TFT 9 is set to a forward potential (set in advance to a value obtained by subtracting a threshold value of the TFT 9 from an anode potential of the light-emitting element 5 with respect to the display current). In other words, when a predetermined potential is defined as Ps, an anode terminal potential of a light-emitting element with respect to a drive current is defined as Pi, and a threshold voltage of the transistor for correction 9 is defined as Vth, a relation among Ps, Pi and Vth is set as Ps=Pi+Vth, and the diode 13 serving as the nonlinear element is designed such that a source potential of the transistor for correction is a predetermined potential Ps. As a result, an amount of a voltage increased by the deterioration can be extracted as a source-to-drain current (correction signal) of the TFT 9.

At time t3, Vg2 rises to H, Vg4 falls to L, and TFTs 8 and 15 are turned OFF, at the same time, Vg3 rises to H, Vg5 falls to L, and the TFTs 9, 12 and 16 are turned ON. As a result, the source-to-drain current of the TFT 9 flows from the capacitor 2, and gate voltage of the TFT 3 falls.

At time t4, Vg3 falls to L, Vg5 rises to H, and the TFTs 12 and 16 are turned OFF and, at the same time, Vg2 falls to L and the TFT 15 is turned ON. An electrical current obtained by adding a correction signal of an amount of the deterioration to the display current flows to the light-emitting element 5, and the light-emitting element 5 emits light at the same luminance as that before the deterioration. Since a relation between the electrical current and the luminance is linear, the luminance is corrected according to the relation shown in FIG. 10.

In this embodiment, it is also possible to multiply the correction signal with a coefficient by adjusting a size of the TFT 9.

As in the respective embodiments described above, the TFTs 8 and 12, serving as the switching transistors, are turned ON for each predetermined period, for example, a period of one frame or a period of several frames, an impedance of a load (which can also be regarded as a resistance or an anode voltage) is detected, and a drive current is corrected on the basis of the impedance, whereby it is possible to drive the load with an electrical current necessary for causing a desired phenomenon. A typical example of the embodiments is a pixel circuit using an organic EL element.

Fourth Embodiment

Figure 6:
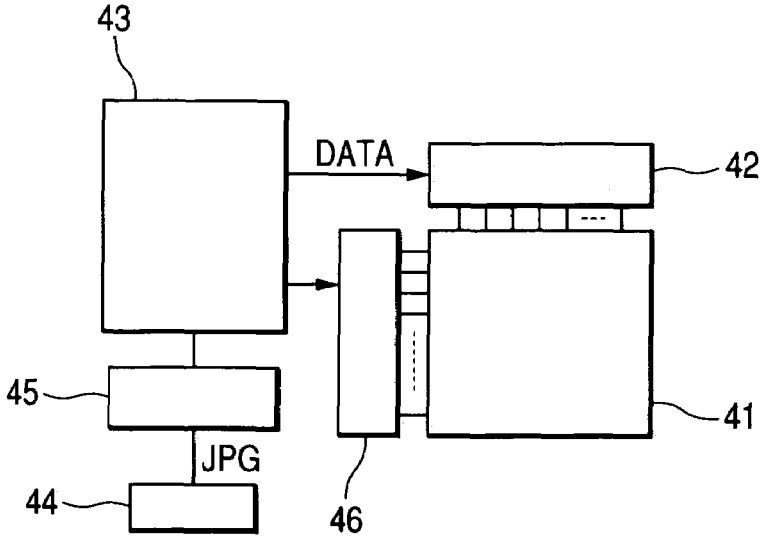
FIG. 6 is a circuit diagram for explaining a basic principle of the invention.

An image forming apparatus of this embodiment, shown in FIG. 6, uses a large number of the pixel circuits in the first to third embodiments described above. The pixel circuit group is arranged in a two-dimensional matrix shape, and the image forming apparatus includes a display unit 41 for forming an image in the pixel circuit group according to light emission of the light-emitting element. In addition, a line drive circuit 42 supplies an image signal (Vsig or Idata) to the pixel circuit group. The display unit 41 is controlled to be driven by the line drive circuit 42 and a row selection circuit 46. Preferably, an image data supply circuit 43 that supplies analog or digital image data DATA to the line drive circuit 42 can perform image processing, such as contrast adjustment, gamma adjustment, sharpness adjustment, and scaling. Moreover, the image forming apparatus includes a decoder 45 that decodes compressed image data JPG stored in a storage medium 44 and supplies the decoded image data to the image data supply circuit 43. This image forming apparatus is used as a TV receiver, a digital camera, or a monitor of a digital video camera recorder suitably.

Fifth Embodiment

Figure 7:
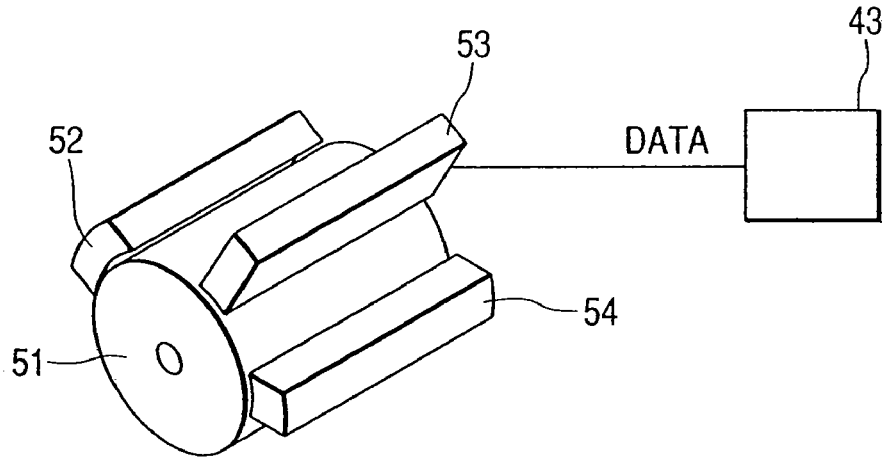
FIG. 7 is a voltage characteristic chart in a circuit shown in FIG. 6.

An image forming apparatus of this embodiment, shown in FIG. 7, uses a large number of the pixel circuits of the first to third embodiments described above. The pixel circuit group is arranged at least in a one-dimensional matrix shape and constitutes a light-emitting element array. This image forming apparatus is a printer of an electrophotographic system and includes a photosensitive member 51, a charging device 52 for charging the photosensitive member 51, and an exposing device 53 for forming a latent image on the photosensitive member 51 according to light emission of the light-emitting element.

In addition, this image forming apparatus includes a developing device 54. A line drive circuit (not shown) in the exposing device 53 supplies an image signal to the pixel circuit group, the light-emitting element array emits light in synchronization with the image signal, and the photosensitive member 51 rotates. As the image data supply circuit 43 that supplies image data to the line drive circuit, it is possible to use the same image data supply circuit as that in the fourth embodiment. However, since only a still image is handled in this embodiment, an internal structure of the image data supply circuit 43 is different.

What is claimed is:

1. A drive circuit comprising:

a drive transistor for feeding to a load a drive current corresponding to an input signal, wherein the drive circuit has a correction circuit that supplies a correction signal corresponding to an impedance of the load to a gate of the drive transistor to correct the drive current to be fed to the load by the drive transistor, and wherein the load is a light-emitting element, one terminal of the light-emitting element is connected to a gate of a transistor for correction, and when a predetermined potential Ps is set to a value calculated by deducting a threshold voltage Vth of the transistor for correction from a terminal potential Pi of the light-emitting element with respect to a drive current, the drive circuit sets a source potential of the transistor for correction to the predetermined potential Ps to thereby generate a voltage corresponding to an impedance of the light-emitting element as a source-to-drain current of the transistor for correction.

2. The drive circuit according to claim 1, wherein the drive circuit inputs the source-to-drain current of the transistor for correction to the gate of the drive transistor as the correction signal.

3. The drive circuit according to claim 1, wherein the drive circuit sets the source potential of the transistor for correction using a nonlinear element having a variable bias voltage or diode characteristic.

4. The drive circuit according to claim 1, wherein it is possible to multiply the correction signal with a coefficient according to a setting for a size of the transistor for correction.

5. An image forming apparatus comprising:

a pixel circuit group in which plural pixel circuits, which include (i) a light-emitting element, wherein the light-emitting element is an organic electroluminescent element, and (ii) a drive transistor for feeding a drive current corresponding to an input signal to the light-emitting element, are arranged, wherein each of the pixel circuits has a correction circuit that supplies a correction signal corresponding to an impedance of a load to a gate of the drive transistor and corrects the drive current to be fed to the light-emitting element by the drive transistor;

a photosensitive member;

a charging device for charging the photosensitive member;

an exposure device that has the pixel circuit group arranged at least in a one-dimensional matrix shape and is used for forming a latent image on the photosensitive member according to light emission of the light-emitting element;

a developing device;

a line drive circuit that supplies an image signal to the pixel circuit group; and an image data supply circuit that supplies image data to the line drive circuit.

6. A drive circuit comprising:

a drive transistor for feeding a drive current corresponding to an input signal to a load;

a storage capacitor that is connected to a control electrode of the drive transistor and used for retaining an input signal;

a detection circuit for detecting a resistance of the load, wherein the detection circuit includes a second capacitor that is connected to a terminal, which is connected to the load, via a switching transistor; and a correction circuit that feeds back a result of the detection by the detection circuit to the drive transistor to correct a drive current to be fed to the load by the drive transistor, wherein the correction circuit includes a transistor for correction that has a control electrode connected to the second capacitor and is used for changing a potential of the control electrode of the drive transistor.

7. An image forming apparatus comprising:

(a) a pixel circuit group in which plural pixel circuits are arranged, which include a light-emitting element serving as a load and a drive circuit, said drive circuit comprising:

(i) a drive transistor for feeding a drive current corresponding to an input signal to a load;

(ii) a storage capacitor that is connected to a control electrode of the drive transistor and used for retaining an input signal;

(iii) a detection circuit for detecting a resistance of the load; and (iv) a correction circuit that feeds back a result of the detection by the detection circuit to the drive transistor to correct a drive current to be fed to the load by the drive transistor;

(b) a photosensitive member;

(c) a charging device for charging a photosensitive member;

(d) an exposing device that has the pixel circuit group arranged at least in a one-dimensional matrix shape and is used for forming a latent image on a photosensitive member according to light emission of the light-emitting element;

(e) a developing device;

(f) a line drive circuit that supplies an image signal to the pixel circuit group; and (g) an image data supply circuit that supplies image data to the line drive circuit.

* * * * *